US009255532B2

(12) United States Patent
Genko

(10) Patent No.: US 9,255,532 B2
(45) Date of Patent: Feb. 9, 2016

(54) AIR-FUEL RATIO CONTROL SYSTEM OF INTERNAL COMBUSTION ENGINE

(71) Applicant: Takeshi Genko, Toyota (JP)

(72) Inventor: Takeshi Genko, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 539 days.

(21) Appl. No.: 13/676,455

(22) Filed: Nov. 14, 2012

(65) Prior Publication Data

US 2013/0133635 A1 May 30, 2013

(30) Foreign Application Priority Data

Nov. 24, 2011 (JP) ..... 2011-256736

(51) Int. Cl.

| | |
|---|---|
| ***F01N 3/08*** | (2006.01) |
| ***F02D 41/02*** | (2006.01) |
| ***F02D 41/00*** | (2006.01) |
| ***F02D 41/14*** | (2006.01) |
| ***F02D 41/24*** | (2006.01) |
| ***F02M 25/07*** | (2006.01) |

(52) U.S. Cl.

CPC ..... *F02D 41/00* (2013.01); *F02D 41/1441* (2013.01); *F02D 41/1475* (2013.01); *F02D 41/2461* (2013.01); *F02M 25/0702* (2013.01); *F01N 3/0842* (2013.01); *F02D 41/0072* (2013.01)

(58) Field of Classification Search

CPC ... F01N 3/0842; F01N 13/009; F01N 13/011; F01N 13/107; F02D 41/1456; F02D 41/1454; F02D 41/1441; F02D 41/0072; F02M 25/0772

USPC ..... 123/674, 568.21; 701/108, 109

See application file for complete search history.

(56) References Cited

U.S. PATENT DOCUMENTS

| | | | | |
|---|---|---|---|---|
| 5,241,943 | A | 9/1993 | Miyashita et al. | |
| 5,964,811 | A | 10/1999 | Ishii et al. | |
| 6,383,267 | B1 * | 5/2002 | Takaku et al. | 96/111 |
| 2003/0221655 | A1 * | 12/2003 | Surnilla et al. | 123/198 F |
| 2003/0221659 | A1 * | 12/2003 | Surnilla et al. | 123/295 |
| 2003/0221666 | A1 * | 12/2003 | Surnilla et al. | 123/339.19 |

FOREIGN PATENT DOCUMENTS

| | | | |
|---|---|---|---|
| JP | 03-210038 | A | 9/1991 |
| JP | 04-001439 | A | 1/1992 |

(Continued)

*Primary Examiner* — Hai Huynh
*Assistant Examiner* — Gonzalo Laguarda
(74) *Attorney, Agent, or Firm* — Dinsmore & Shohl LLP

(57) ABSTRACT

An air-fuel ratio control system of an internal combustion engine includes a controller that performs air-fuel ratio feedback control through main feedback control and sub feedback control based on the concentrations of oxygen in exhaust gas upstream and downstream of a catalyst respectively, and the controller stores a constant component of a sub feedback correction value of the sub feedback control as a sub feedback learned value, and sets a feedback target value of the main feedback control to values that are different depending on whether or not exhaust gas is recirculated into intake air. When the constant component of the sub feedback correction value obtained when the amount of recirculated exhaust gas is short of its required amount is stored as the sub feedback learned value, the controller corrects the feedback target value of the main feedback control when the recirculation of exhaust gas is not conducted.

6 Claims, 5 Drawing Sheets

(56) References Cited

FOREIGN PATENT DOCUMENTS

| | | | |
|---|---|---|---|
| JP | 05-059988 | A | 3/1993 |
| JP | 06-058197 | A | 3/1994 |
| JP | 07-091304 | A | 4/1995 |
| JP | 08-291739 | A | 11/1996 |
| JP | 2005-030339 | A | 2/2005 |
| JP | 2006-125370 | A | 5/2006 |
| JP | 2011-169197 | A | 9/2011 |
| WO | 2012056515 | A1 | 5/2012 |

* cited by examiner

AIR-FUEL RATIO CONTROL SYSTEM OF INTERNAL COMBUSTION ENGINE

The disclosure of Japanese Patent Application No. 2011-256736 filed on Nov. 24, 2011 including the specification, drawings and abstract is incorporated herein by reference in its entirety.

BACKGROUND OF THE INVENTION

1. Field of the Invention

The invention relates to an air-fuel ratio control system of an internal combustion engine, which performs air-fuel ratio feedback control through main feedback control based on the concentration of oxygen in exhaust gas upstream of a catalyst, and sub feedback control based on the concentration of oxygen in exhaust gas downstream of the catalyst.

2. Description of the Related Art

In the internal combustion engine installed on a vehicle, for example, a catalyst provided in an exhaust passage cleans up harmful components in exhaust gas. The catalyst's ability to purify exhaust gas varies depending on the air-fuel ratio as the ratio of air to fuel in an air-fuel mixture burned in a combustion chamber, and the range of the air-fuel ratio within which the catalyst exhibits the maximum exhaust purifying ability is limited. In the case of a three-way catalyst, for example, when the air-fuel ratio of the air-fuel mixture is in the vicinity of the stoichiometric air-fuel ratio at which the entire amount of oxygen in the mixture is theoretically used for combustion of the fuel, the catalyst exhibits the maximum exhaust purifying ability. In many internal combustion engines installed on vehicles, for example, the air-fuel ratio of the mixture burned is obtained from the concentration of oxygen remaining in exhaust gas, and the fuel injection amount is corrected in accordance, with the obtained air-fuel ratio, so that air-fuel ratio feedback control for making the air-fuel ratio of the mixture equal to the optimum value for purification of exhaust gas is performed.

If an oxygen concentration sensor for measuring the concentration of oxygen in exhaust gas is able to show ideal output characteristics, the output of the sensor has a unique relationship with the air-fuel ratio of the air-fuel mixture burned. In this case, if the target air-fuel ratio is set so as to be within a catalyst window as a air-fuel ratio suitable far purification of exhaust gas by the catalyst, and feedback control is executed so that the air-fuel ratio calculated from the measured oxygen concentration of exhaust gas becomes equal to the target air-fuel ratio, only the exhaust gas that has been purified flows out of the catalyst, into the exhaust passage downstream of the catalyst.

However, in reality, the oxygen concentration sensor may not necessarily exhibit ideal output characteristics, due to individual differences and chronological changes in the oxygen concentration sensor and its signal transmission system, changes in the operating conditions of the internal combustion engine, etc. Therefore, even under a situation where the air-fuel ratio feedback control is executed, unpurified exhaust gas may flow downstream of the catalyst. In this case, the oxygen concentration of exhaust gas downstream of the catalyst deviates from a value corresponding to the stoichiometric air-fuel ratio established when the amount of oxygen in exhaust gas is not excessive nor insufficient for exhaust purifying reactions. Therefore, it can be determined from the measurement result of the concentration of oxygen in exhaust gas downstream of the catalyst whether exhaust gas is appropriately purified in the catalyst. Thus, more accurate air-fuel ratio control is realized by performing sub feedback control based on the oxygen concentration of exhaust gas downstream of the catalyst, in addition to main feedback control based on the oxygen concentration of exhaust gas upstream of the catalyst.

A certain length of time is required for the result of the sub feedback control to converge on the optimum value. Therefore, a constant component of a sub feedback correction value obtained in the past sub feedback control is stored as a sub feedback learned value, and the learned value is reflected by the sub feedback control, in an attempt to reduce the time required for convergence.

In some types of internal combustion engines installed on vehicles, exhaust gas recirculation (EGR) for recirculating a part of exhaust gas into intake air is conducted. In the internal combustion engine having the EGR function, it is found that the catalyst window changes when the EGR is carried out. Thus, an air-fuel ratio control system that sets a feedback target value (target air-fuel ratio) of air-fuel ratio feedback control to values that are different depending on whether or not the EGR is conducted has been proposed, as described in Japanese Patent Application Publication No. 2005-030339 (JP 2005-030339 A). This type of air-fuel ratio control system changes the air-fuel ratio of the air-fuel mixture in accordance with change of the catalyst window depending on whether or not the EGR is conducted. Thus, the control system provides advantageous effects, such as reduction of NOx and improvement of the fuel efficiency, owing to the EGR, while assuring desired exhaust purifying efficiency of the catalyst.

In the air-fuel ratio control system of the internal combustion engine which performs sub feedback control as described above, if the feedback target value (target air-fuel ratio) of the main feedback control is set to values that are different depending on whether or not the EGR is conducted, it is possible to achieve advantageous effects, such as reduction of NOx and improvement of the fuel efficiency, owing to the EGR, while assuring desired exhaust purifying efficiency of the catalyst.

If an EGR valve is stuck in a closed position, namely if the EGR valve is held closed and will not open, the amount of exhaust gas recirculated into the intake air during execution of the EGR may be reduced to be smaller than the originally required amount. In this case, the amount of change in the catalyst window due to the EGR is smaller than that in the case where the EGR is normally conducted.

In this case, the target air-fuel ratio of the main feedback control is set on the assumption that the EGR amount as required is ensured; therefore, the target air-fuel ratio is set to a value that deviates from the actual catalyst window. The deviation of the target air-fuel ratio from the actual catalyst window is compensated for through sub feedback control. Therefore, if the air-fuel ratio feedback control is continued in this condition, the deviation is taken into the sub feedback learned value. Namely, the sub feedback learned value obtained at this time deviates from a proper value by an amount corresponding to a difference between the catalyst window in the case where the EGR is normally conducted and the catalyst window in the case where the EGR is not normally conducted. Therefore, if the EGR is subsequently stopped, and the feedback target value of the main feedback control is changed to the value to be achieved when the EGR is not conducted, a shift may occur to the air-fuel ratio under an influence of the deviation of the sub feedback learned value as described above. In this case, emissions (or exhaust characteristics) of the internal combustion engine may deteriorate until the air-fuel ratio feedback control settles.

SUMMARY OF THE INVENTION

The invention provides an air-fuel ratio control system of an internal combustion engine, which is able to favorably suppress deterioration of emissions of the internal combustion engine when exhaust gas recirculation was not normally conducted.

A first aspect of the invention provides an air-fuel ratio control system of an internal combustion engine including a controller that performs air-fuel ratio feedback control through main feedback control based on a concentration of oxygen in exhaust gas upstream of a catalyst and sub feedback control based on the concentration of oxygen in exhaust gas downstream of the catalyst. The controller stores a constant component of a sub feedback correction value of the sub feedback control as a sub feedback learned value, and sets a feedback target value of the main feedback control to values that are different depending on whether or not exhaust gas is recirculated into intake air. In the air-fuel ratio control system, when the constant component of the sub feedback correction value obtained when an amount of recirculated exhaust gas is short of a required amount thereof is stored as the sub feedback learned value, the controller corrects the feedback target value of the main feedback control when the recirculation of exhaust gas is not conducted.

With the above arrangement, the feedback target value of the main feedback control is set to values that are different depending on whether or not exhaust gas is recirculated into intake air. In this manner, the air-fuel ratio of the air-fuel mixture is changed in accordance with change of the catalyst window depending on whether or not exhaust gas recirculation is conducted. In the meantime, if the amount of recirculated exhaust gas during recirculation of exhaust gas is kept short of or smaller than the required amount, a difference between the catalyst window in the case where the amount of recirculated exhaust gas as required is surely provided and the catalyst window corresponding to the actual amount of recirculated exhaust gas which is short of the required amount is taken into the sub feedback learned value learned during recirculation of exhaust gas, and the sub feedback learned value deviates from a proper value by an amount corresponding to the above-mentioned difference. With the above arrangement, if the sub feedback learned value learned in the above condition is stored, the feedback target value of the main feedback control when the exhaust gas recirculation is not conducted is corrected. As a result, a shift of the air-fuel ratio due to the deviation of the sub feedback learned value is compensated for. Thus, the above arrangement makes it possible to favorably suppress deterioration of the emissions of the internal combustion engine when the exhaust gas recirculation was not normally conducted.

A second aspect of the invention provides an air-fuel ratio control system of an internal combustion engine including a controller that performs air-fuel ratio feedback control through main feedback control based on a concentration of oxygen in exhaust gas upstream of a catalyst and sub feedback control based on the concentration of oxygen in exhaust gas downstream of the catalyst. The controller stores a constant component of a sub feedback correction value of the sub feedback control as a sub feedback learned value, and sets a feedback target value of the main feedback control to values that are different depending on whether or not exhaust gas is recirculated into intake air. In the system, when the constant component of the sub feedback correction value obtained when an amount of recirculated exhaust gas is short of a required amount is stored as the sub feedback learned value, the controller corrects a feedback target value of the sub feedback control when the recirculation of exhaust gas is not conducted.

With the above arrangement, the feedback target value of the main feedback control is set to values that are different depending on whether or not exhaust gas is recirculated into intake air. In this manner, the air-fuel ratio of the air-fuel mixture is changed in accordance with change of the catalyst window depending on whether or not exhaust gas recirculation is conducted. In the meantime, if the amount of recirculated exhaust gas during recirculation of exhaust gas is kept short of or smaller than the required amount, a difference between the catalyst window in the case where the amount of recirculated exhaust gas as required is surely provided and the catalyst window corresponding, to the actual amount of recirculated exhaust gas which is short of the required amount is taken into the sub feedback learned value learned during recirculation of exhaust gas, and the sub feedback learned value deviates from a proper value by an amount corresponding to the above-mentioned difference. With the above arrangement, if the sub feedback learned value learned in the above condition is stored, the feedback target value of the sub feedback control when the exhaust gas recirculation is not conducted is corrected. As a result, a shift of the air-fuel ratio due to the deviation of the sub feedback learned value is compensated for. Thus, the above arrangement makes it possible to favorably suppress deterioration of the emissions of the internal combustion engine when the exhaust gas recirculation was not normally conducted.

In the air-fuel ratio control system as described above, the feedback target value may be corrected so that the feedback target value to be achieved when the recirculation of exhaust gas is not conducted is set to a value that provides a leaner air-fuel ratio as the amount of shortage of recirculated exhaust gas relative to a required amount thereof is larger. Due to a deviation of the sub feedback learned value learned in a condition where the amount of recirculated exhaust gas is short of the required amount from a proper value, the air-fuel ratio shifts to the richer side when the exhaust gas recirculation is not conducted as the amount of shortage of recirculated exhaust gas relative to the required amount is larger. With the above arrangement, deterioration of emissions of the internal combustion engine when exhaust gas recirculation was not normally conducted can be more appropriately suppressed.

A third aspect of the invention provides an air-fuel ratio control system of an internal combustion engine including a controller that performs air-fuel ratio feedback control through main feedback control based on a concentration of oxygen in exhaust gas upstream of a catalyst and sub feedback control based on the concentration of oxygen in exhaust gas downstream of the catalyst. The controller stores a constant component of a sub feedback correction value of the sub feedback control as a sub feedback learned value, and sets a feedback target value of the main feedback control to values that are different depending on whether or not exhaust gas is recirculated into intake air. In the air-fuel ratio control system, when the constant component of the sub feedback correction value obtained when an amount of recirculated exhaust gas is short of a required amount thereof is stored as the sub feedback learned value, the controller corrects the sub feedback learned value when the recirculation of exhaust gas is not conducted.

With the above arrangement, the feedback target value of the main feedback control is set to values that are different depending on whether or not exhaust gas is recirculated into intake air. In this manner, the air-fuel ratio of the air-fuel mixture is changed in accordance with change of the catalyst window depending on whether or not exhaust gas recirculation is conducted. In the meantime, if the amount of recirculated exhaust gas during recirculation of exhaust gas is kept short of or smaller than the required amount, a difference between the catalyst window in the case where the amount of recirculated exhaust gas as required is surely provided and the catalyst window corresponding to the actual amount of recirculated exhaust gas which is short of the required amount is taken into the sub feedback learned value learned during recirculation of exhaust gas, and the sub feedback learned value deviates from a proper value by an amount corresponding to the above-mentioned difference. With the above arrangement, if the constant component of the sub feedback correction value obtained when the amount of recirculated exhaust gas is short of the required amount is learned as the sub feedback learned value, the sub feedback learned value is corrected, and the deviation is eliminated. Thus, the above arrangement makes it possible to favorably suppress deterioration of the emissions of the internal combustion engine when the exhaust gas recirculation was not normally conducted.

In the air-fuel ratio control system as described above, the sub feedback learned value may be corrected so that the amount of correction of the air-fuel ratio to the rich side, which is made by the sub feedback learned value, is reduced as the amount of shortage of the amount of recirculated exhaust gas relative to the required amount is larger. With this arrangement, deterioration of the emissions of the internal combustion engine when exhaust gas recirculation was not normally conducted can be more appropriately suppressed.

BRIEF DESCRIPTION OF THE DRAWINGS

The features, advantages, and technical and industrial significance of this invention will be described in the following detailed description of exemplary embodiments of the invention with reference to the accompanying drawings, in which like numerals denote like elements, and wherein.

DETAILED DESCRIPTION OF EMBODIMENTS

First Embodiment

A first embodiment of the invention in the form of an air-fuel ratio control system of an internal combustion engine will be described in detail with reference to FIG. 1 through FIG. 4.

Figure 1:
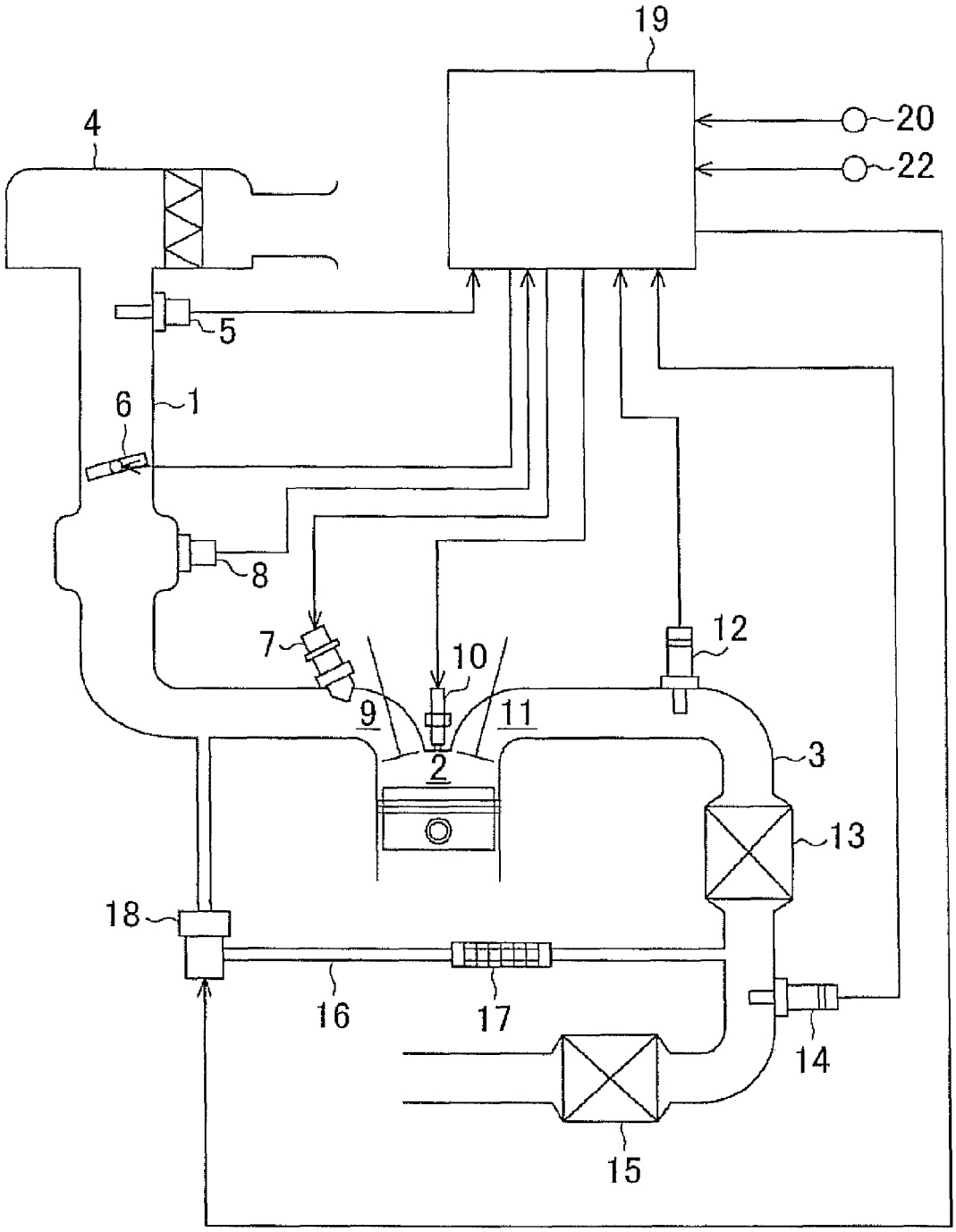
FIG. 1 is a view schematically showing the construction of an internal combustion engine in which an air-fuel ratio control system according to a first embodiment of the invention is used.

Referring to FIG. 1, the construction of the internal combustion engine in which the air-fuel ratio control system of this embodiment is used will be described. As shown in FIG. 1, the internal combustion engine using the control system of this embodiment includes an intake pipe 1 through which intake air passes, a combustion chamber 2 in which an air-fuel mixture of air drawn into the chamber 2 through the intake pipe 1 and fuel is burned, and an exhaust pipe 3 through which exhaust gas generated through combustion passes.

In the intake pipe 1 of the internal combustion engine, an air cleaner 4 that cleans intake air, an air flow meter 5 that measures the intake air amount, a throttle valve 6 that adjusts the flow rate of the intake air, an intake pressure sensor 8 that measures the intake pressure, and an injector 7 that injects and supplies fuel into the intake air are arranged in the order of description in a direction from the upstream end toward the downstream end of the intake pipe 1. An ignition plug 10 operable to ignite an air-fuel mixture of air and fuel drawn into the combustion chamber 2 is placed in the combustion chamber 2 connected to the intake pipe 1 via an intake port 9. In the exhaust pipe 3 connected to the combustion chamber 2 via an exhaust port 11, a main oxygen concentration sensor 12 that measures the concentration of oxygen in exhaust gas, a front catalyst 13 that purifies exhaust gas, a sub oxygen concentration sensor 14 that measures the concentration of oxygen in exhaust gas, and a rear catalyst 15 that purifies exhaust gas are arranged in the order of description in a direction from the upstream end toward the downstream end of the exhaust pipe 3.

The internal combustion engine is provided with an exhaust gas recirculation (EGR) passage 16 through which a part of exhaust gas is recirculated into intake air. The EGR passage 16 is connected at one end to a portion of the exhaust pipe 3 between the front catalyst 13 and the rear catalyst 15. The other end of the EGR passage 16 opposite to the above-indicated one end connected to the exhaust pipe 3 is connected to a portion of the intake pipe 1 located downstream of the throttle valve 6. An EGR cooler 17 for cooling recirculated exhaust gas, and an EGR valve 18 for adjusting the EGR amount (i.e., the amount of recirculated exhaust gas) are placed in the EGR passage 16.

An electronic control unit 19 controls the internal combustion engine as described above. The electronic control unit 19 includes a central processing unit (CPU) that performs various computations associated with engine control, a read-only memory (ROM) in which programs and data for use in control are stored, a random access memory (RAM) that temporarily stores computation results of the CPU, measurement results of sensors, etc., and input/output ports (I/O) that function as interfaces via which signals are received from and transmitted to the outside.

Various sensors including the above-mentioned air flow meter 5, intake pressure sensor 8, main oxygen concentration sensor 12 and sub oxygen concentration sensor 14, an NE sensor 20 that measures the engine speed, and a throttle position sensor 22 that senses the opening of the throttle valve 6, are connected to the input port of the electronic control unit 19. Drive circuits of actuators for use in engine control, including the throttle valve 6, injector 7, ignition plug 10, and the EGR valve 18, are connected to the output port of the electronic control unit 19.

(Air-Fuel Ratio Feedback Control)

In the internal combustion engine as described above, the electronic control unit 19 performs air-fuel ratio feedback control for making the air-fuel ratio of the air-fuel mixture burned in the combustion chamber 2 equal to the optimum value for purification of exhaust gas by the front catalyst 13.

The air-fuel ratio feedback control is performed through main feedback control performed based on the oxygen concentration of exhaust gas upstream of the front catalyst 13, and sub feedback control performed based on the oxygen concentration of exhaust gas downstream of the front catalyst 13.

In the air-fuel ratio feedback control, the electronic control unit 19 calculates a corrected A/F output evabyf expressed by the following equation (1), based on the output of the main oxygen concentration sensor 12 and the output of the sub oxygen concentration sensor 14, and controls the fuel injection amount so that the corrected A/F output evabyf becomes equal to a value corresponding to the target air-fuel ratio. In the following equation (1), the first term "evafbse" on the right side denotes the output voltage of the main oxygen concentration sensor 12, and the second term "evafsfb" on the right side denotes a sub feedback correction value calculated based on the output of the sub oxygen concentration sensor 14, while the third term "evafsfbg" on the right side denotes a sub feedback learned value.

$$evabyf=evafbse+evafsfb+evafsfbg \quad (1)$$

The electronic control unit 19 executes main feedback control for making the corrected A/F output evabyf calculated according to the above equation (1) close to or equal to the value corresponding to the target air-fuel ratio. More specifically, in the main feedback control, the electronic control unit 19 performs an operation to convert the corrected A/F output evabyf into the air-fuel ratio, an operation to calculate a deviation ΔA/F of the obtained air-fuel ratio from the target air-fuel ratio, and an operation to correct the fuel injection amount so that the deviation ΔA/F is reflected at a given gain by the fuel injection amount.

If the main oxygen concentration sensor 12 shows ideal output characteristics, the output evafbse of the sensor 12 has a unique relationship with the air-fuel ratio of the mixture burned. In this case, if the target air-fuel ratio is set so as to fall within a catalyst window of the front catalyst 13, and the main feedback control is executed so that the output evafbse of the main oxygen concentration sensor 12 becomes equal to the value corresponding to the target air-fuel ratio, only purified exhaust gas flows into a portion of the exhaust pipe 3 downstream of the front catalyst 13.

However, in reality, the main oxygen concentration sensor 12 may not necessarily exhibit ideal output characteristics, due to individual differences and chronological changes in the main oxygen concentration sensor 12 and its signal transmission system, changes in the operating conditions of the internal combustion engine, etc. Therefore, even under a situation where the main feedback control is executed, unpurified exhaust gas may flow downstream of the front catalyst 13. In this case, the oxygen concentration of exhaust gas downstream of the front catalyst 13 deviates from a value corresponding to the stoichiometric air-fuel ratio established when the amount of oxygen in exhaust gas is not excessive nor insufficient for exhaust purifying reactions. Therefore, it can be determined from the measurement result of the sub oxygen concentration sensor 14 whether exhaust gas is appropriately purified in the front catalyst 13.

When the oxygen concentration sensed by the sub oxygen concentration sensor 14 is lower than the value corresponding to the stoichiometric air-fuel ratio, for example, it can be determined that the air-fuel ratio of the mixture as a whole is shifted to be richer than the catalyst window of the front catalyst 13. In this case, the output evafbse of the main oxygen concentration sensor 12 is corrected so that the calculated fuel injection amount is smaller than the current value, whereby the air-fuel ratio of the mixture obtained as a result of the main feedback control is made closer to the catalyst window of the front catalyst 13.

On the other hand, if the oxygen concentration sensed by the sub oxygen concentration sensor 14 is higher than the value corresponding to the stoichiometric air-fuel ratio, it can be determined that the air-fuel ratio of the mixture as a whole is shifted to be leaner than the catalyst window of the front catalyst 13. In this case, the output evafbse or the main oxygen concentration sensor 12 is corrected so that the calculated fuel injection amount is larger than the current value, whereby the air-fuel ratio of the mixture obtained as a result of the main feedback control is made closer to the catalyst window of the front catalyst 13.

The sub feedback correction value evafsfb included in the above equation (1) is a correction value used for correcting the output evafbse of the main oxygen concentration sensor 12. The electronic control unit 19 calculates the sub feedback correction value evafsfb by performing a certain computation on a deviation of the output of the sub oxygen concentration sensor 14 from a sub feedback target value set as an output value corresponding to the stoichiometric air-fuel ratio. More specifically, the sub feedback correction value evafsfb is calculated as a sum of a proportional term, an integral term, and a derivative term based on the deviation of the output of the sub oxygen concentration sensor 14 from the sub feedback target value.

The integral term as a component included in the sub feedback correction value evafsfb represents a steady-state deviation of the main feedback control. The sub feedback learned value evafsfbg in the above equation (1) is calculated by replacing the learned value evafsfbg with the integral-term component taken from the sub feedback correction value evafsfb in given updating timing.

According to the above processing, the sub feedback learned value evafsfbg absorbs the steady-state deviation component of the main feedback control, and the sub feedback correction value evafsfb absorbs only variations of error components included in the main feedback control. As the learning proceeds, the sub feedback learned value evafsbg converges on a value that properly reflects the steady error (or deviation) component, and stably takes this value.

(Setting of Target Air-Fuel Ratio)

In the internal combustion engine in which the EGR (exhaust gas recirculation) is conducted, the catalyst window of the front catalyst 13 varies depending on whether or not the EGR is conducted. In this embodiment, the target air-fuel ratio as the feedback target value of the main feedback control is set to values that are different depending on whether or not the EGR is conducted, so that the air-fuel ratio follows the change of the catalyst window of the front catalyst 13 depending on whether or not the EGR is conducted.

More specifically, the electronic control unit 19 calculates the target air-fuel ratio eabyfref according to the following equation (2).

$$eabyfref=\gamma\times G(NE,KL)+(1-\gamma)\times F(NE,KL) \quad (2)$$

In the above equation (2), "F(NE, KL)" represents the catalyst window of the front catalyst 13 when the EGR is not implemented, where NE denotes the current engine speed, and KL denotes the current engine load. In the above equation (2), "G(NE, KL)" represents the catalyst window of the front catalyst 13 when the EGR is fully implemented at the engine speed NE and engine load KL. The full implementation of the EGR means recirculation of exhaust gas in a condition where the EGR valve 18 is fully opened. When the EGR is conducted, the catalyst window of the front catalyst 13 shifts to the lean side. Therefore, the catalyst window G(NE, KL) of the front catalyst 13 when the EGR is fully implemented at the same engine speed NE and the same engine load KL is a leaner value than the catalyst window F(NE, KL) of the front catalyst 13 when the EGR is not implemented.

In the above equation (2), "γ" denotes the ratio of the EGR amount (i.e., the amount of recirculated exhaust gas) when the EGR is fully implemented at the current engine speed NE and engine load KL and the required EGR amount. Since the ratio γ is equal to "0" when the EGR is not implemented, the target air-fuel ratio eabyfref is set to the catalyst window F(NE, KL) of the front catalyst 13 to be established when the EGR is not implemented. As the required EGR amount increases, the ratio γ approaches "I", so that the target air-fuel ratio eabyfref is set to a leaner value.

(Control for Suppressing Deterioration of Emissions when EGR Fails)

In the case where the target air-fuel ratio eabyfref is changed depending on whether or not the EGR is conducted as described above, if the EGR system fails to satisfy the required EGR amount, such as when the EGR valve 18 is stuck in the closed position, the target air-fuel ratio eabyfref set on the assumption that the EGR is conducted as required deviates to the lean side from the actual catalyst window of the front catalyst 13. At this time, the main feedback control is performed so as to make the air-fuel ratio closer to the target air-fuel ratio eabyfref set on the assumption that the EGR is conducted as required; therefore, the deviation of the target air-fuel ratio eabyfref is compensated for by sub feedback control. Thus, a difference between the actual catalyst window of the front catalyst 13 and the target air-fuel ratio eabyfref is taken into the sub feedback correction value evafsfb obtained through the sub feedback control. If the air-fuel ratio feedback control is continued in the condition where the target air-fuel ratio deviates from the actual catalyst window of the front catalyst 13, the above-mentioned difference is taken into the sub feedback learned value evafsfbg.

If the EGR is stopped in this condition, the target air-fuel ratio eabyfref is changed to the value for the situation where the EGR is not conducted, and the deviation of the target air-fuel ratio from the catalyst window of the front catalyst 13, which appeared due to a shortage of the EGR amount during implementation of the EGR, is eliminated. However, the deviation or difference between the target air-fuel ratio eabyfref and the catalyst window of the front catalyst 13 due to the shortage of the EGR amount during implementation of the EGR is incorporated in the sub feedback learned value evafsfbg at this time. Therefore, if the sub feedback learned value evafsfbg is reflected by the air-fuel ratio feedback control as it is, a shift corresponding to the deviation occurs to the air-fuel ratio immediately after the EGR is stopped, and the emissions of the internal combustion engine may deteriorate until the air-fuel ratio feedback control settles.

Figure 2:
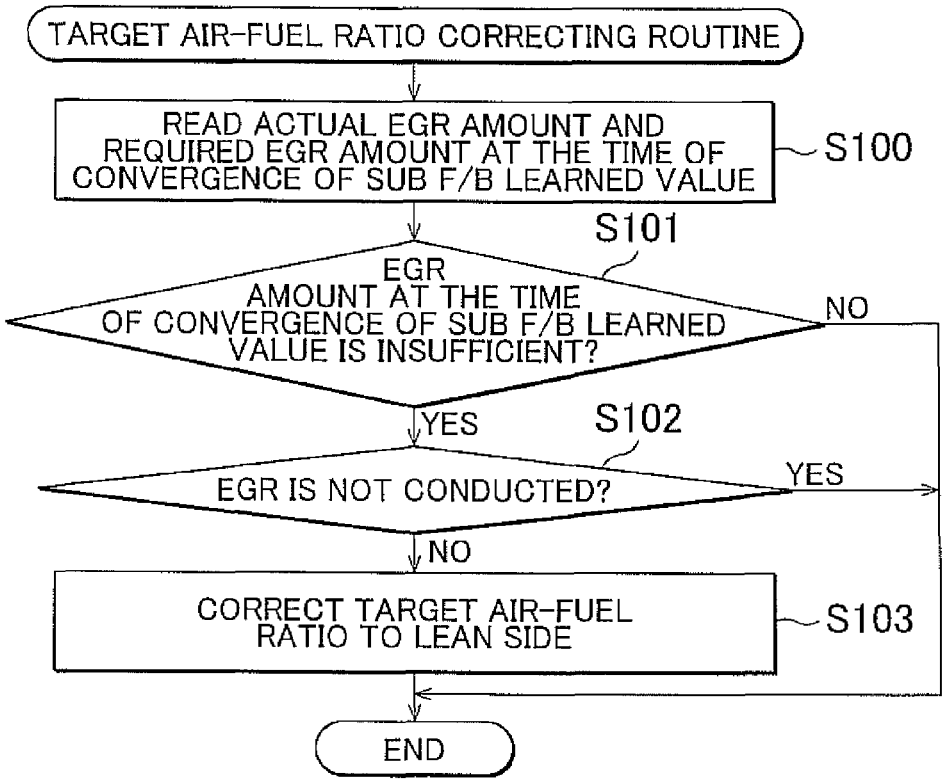
FIG. 2 is a flowchart illustrating a series of steps of a target air-fuel ratio correcting routine executed in the first embodiment of the invention.
Figure 3:
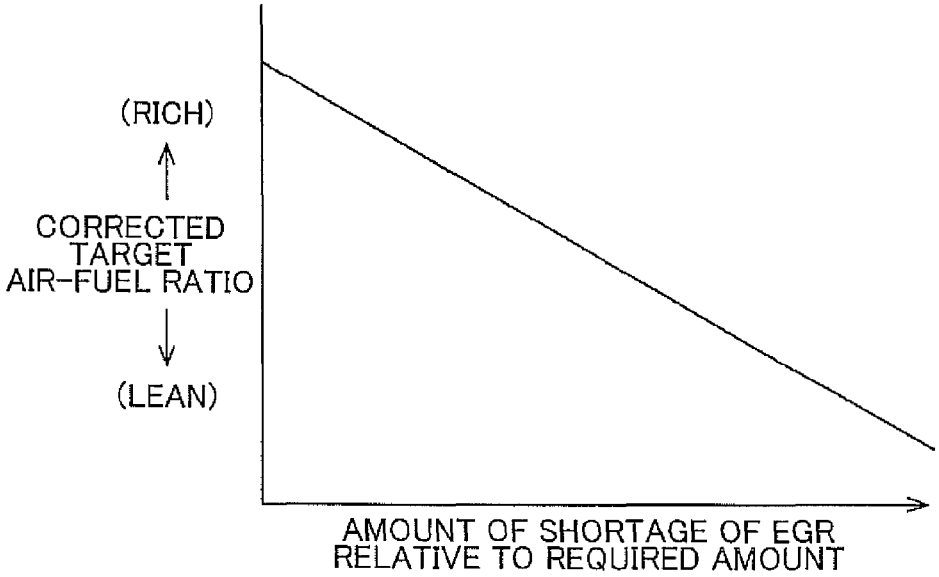
FIG. 3 is a graph indicating the relationship between a target air-fuel ratio corrected according to the target air-fuel ratio correcting routine, and the amount of shortage of EGR gas (i.e., recirculated exhaust gas)

In this embodiment, the control for suppressing deterioration of emissions when the EGR fails is performed so as to suppress deterioration of the emissions. The control for suppressing deterioration of emissions when the EGR fails according to this embodiment is performed by executing a routine of correcting the target air-fuel ratio as shown in FIG. 2. The electronic control unit 19 repeatedly executes the routine of FIG. 2 at specified control intervals during operation of the engine.

Once the processing of this routine is started, the required EGR amount and the actual EGR amount at the time of convergence of the sub feedback (sub FIB) learned value evafsfbg are read in step S100. The required EGR amount is set according to the engine speed NE and the engine load KL, and the actual EGR amount is calculated from the measurement value of the intake pressure sensor 8. If the EGR is conducted, the flow rate of the intake air in the intake pipe 1 is increased by the amount of exhaust gas recirculated into the intake air, resulting in a reduction of the intake pressure. Therefore, the EGR amount, or the amount of exhaust gas actually introduced into the intake pipe 1, can be estimated from a change in the intake pressure due to implementation of the EGR.

In the following step S101, it is determined whether the EGR amount is insufficient when the sub feedback learned value evafsfbg converges. In this step, it is determined whether a constant component of the sub feedback correction value evafsfb obtained when the EGR amount is short of the required amount is stored as the sub feedback learned value evafsfbg.

If the EGR amount at the time of convergence of the sub feedback learned value evafsfbg is not insufficient (S101: NO), the current cycle of this routine ends. On the other hand, if the EGR amount at the time of convergence of the sub feedback learned value evafsfbg is insufficient, the control proceeds to step S102.

In step S102, it is determined whether the EGR is not being conducted at the moment. If the EGR is being conducted (S102: YES), the current cycle of this routine ends. If the EGR is not being conducted (S102: NO), the control proceeds to step S103.

In step S103, the target air-fuel ratio eabyfref is corrected, and then the current cycle of this routine ends. In this step, the target air-fuel ratio eabyfref is changed to a value that is leaner as the amount of shortage of the EGR amount relative to the required amount at the time of convergence of the sub feedback learned value evafsfbg is larger.

The operation during the air-fuel feedback control according to this embodiment will be described with reference to FIG. 4. If the EGR is started at time t1 during the air-fuel ratio feedback control, the target air-fuel ratio eabyfref of the main feedback control is changed to a leaner value than the value for the situation where the EGR is not conducted, in accordance with a change of the catalyst window of the front catalyst 13 resulting from the start of the EGR. Then, the main feedback control is performed so that the corrected A/F output evabyf becomes closer to the value corresponding to the target air-fuel ratio eabyfref thus changed.

Figure 4:
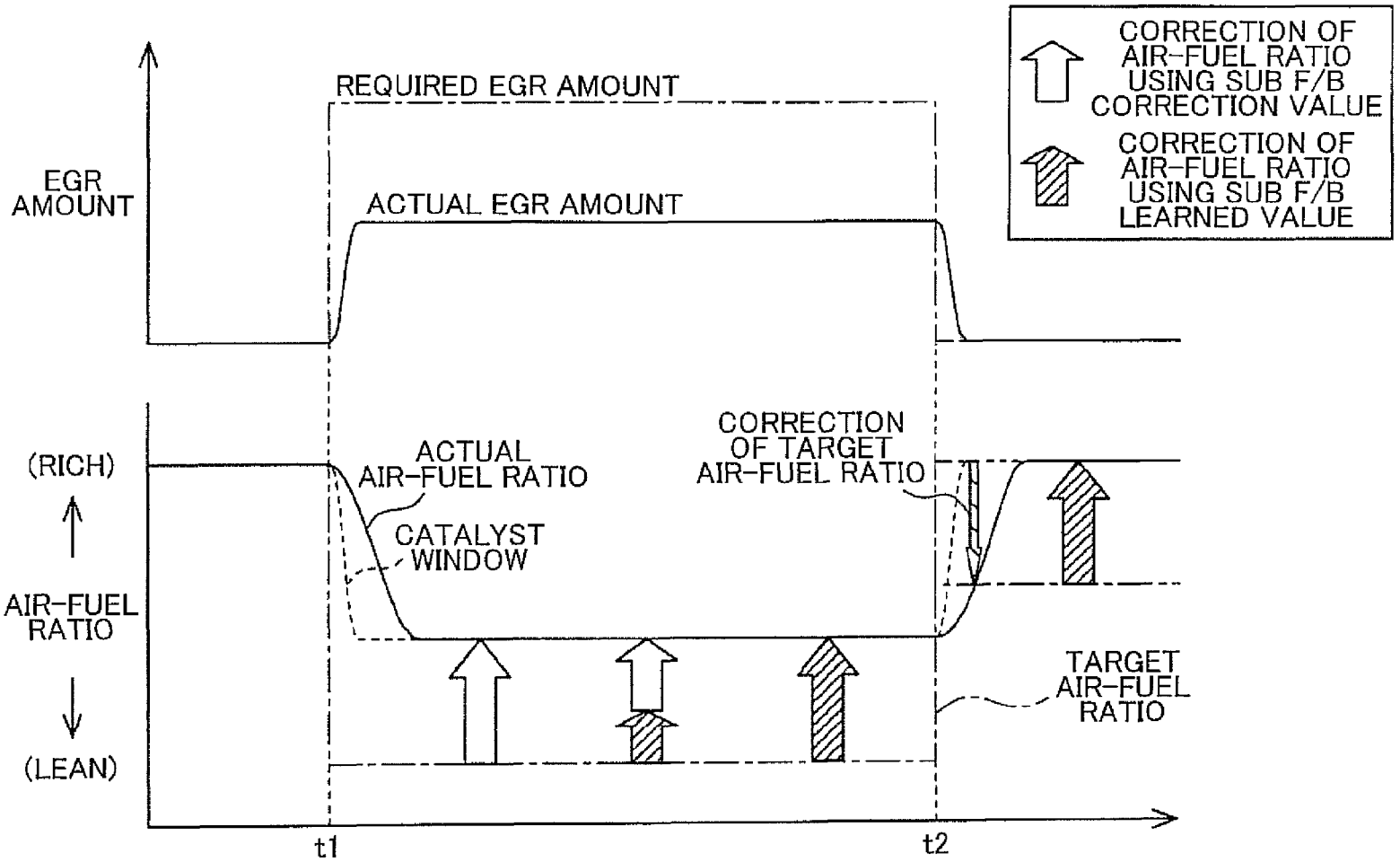
FIG. 4 is a time chart showing one example of control operation under air-fuel ratio feedback control of the first embodiment.

The actual EGR amount as shown in FIG. 4 is short of or smaller than the required EGR amount because the EGR valve 18 is stuck in a certain position. In this case, the change of the catalyst window of the front catalyst 13 due to the implementation of the EGR is smaller than that in the case where the EGR is normally conducted. Therefore, there arises a deviation of the target air-fuel ratio eabyfref set on the assumption that the required EGR amount is ensured, from the actual catalyst window of the front catalyst 13. The deviation of the target air-fuel ratio eabyfref is compensated for through correction of the air-fuel ratio using the sub feedback correction value evafsfb.

If the air-fuel ratio feedback control is continued in the above condition where the target air-fuel ratio deviates from the actual catalyst window, the integral-term component of the sub feedback correction value evafsfb is reflected by the sub feedback learned value evafsfbg. Therefore, the deviation of the target air-fuel ratio eabyfref from the catalyst window due to the shortage of the EGR amount is taken into the sub feedback learned value evafsfbg.

Subsequently, if the EGR is stopped at time t2, the target air-fuel ratio eabyfref is changed to the value corresponding to the catalyst window of the front catalyst 13 for the situation where the EGR is not conducted; therefore, the deviation of the target air-fuel ratio eabyfref from the catalyst window of the front catalyst 13 is eliminated. However, the deviation that appeared during implementation of the EGR is incorporated in the sub feedback learned value evafsfbg at this time. If the sub feedback learned value evafsfbg is reflected as it is by the air-fuel ratio, the resulting air-fuel ratio may largely deviate from the catalyst window of the front catalyst 13.

In this embodiment, the target air-fuel ratio eabyfref to be achieved when the EGR is not conducted is corrected to the lean side, under a condition that the EGR amount obtained at the time of convergence of the sub feedback learned value evafslbg was short of the required amount. The sub feedback learned value at this time corrects the air-fuel ratio to the rich side. Therefore, the correction of the air-fuel ratio using the sub feedback learned value evafsfbg is cancelled by correction of the target air-fuel ratio eabyfref, and the air-fuel ratio is less likely or unlikely to deviate from the catalyst window of the front catalyst 13 due to the sub feedback learned value evafsbg that was learned in the condition where the EGR amount was insufficient.

The air-fuel ratio control system of the internal combustion engine according to this embodiment yields the following effects. In this embodiment, when the constant component of the sub feedback correction value evafsfb obtained when the EGR amount is short of the required amount is stored as the sub feedback learned value evafsfbg, the target air-fuel ratio eabyfref of the main feedback control when the EGR is not conducted is corrected. Therefore, the deviation of the air-fuel ratio, which appears because the sub feedback learned value evafsfbg learned in the condition where the EGR amount is short of the required amount is reflected by the air-fuel ratio feedback control after the EGR is stopped, is reduced or eliminated. Accordingly, this embodiment makes it possible to favorably suppress deterioration of emissions of the internal combustion engine when the EGR is not normally performed.

In this embodiment, the target air-fuel ratio eabyfref to be achieved when the EGR is not conducted is corrected so that the target air-fuel ratio eabyfref becomes leaner as the amount of shortage of the EGR amount relative to the required amount is larger. It is thus possible to more appropriately suppress deterioration of emissions of the internal combustion engine when the EGR was not normally conducted.

Figure 6:
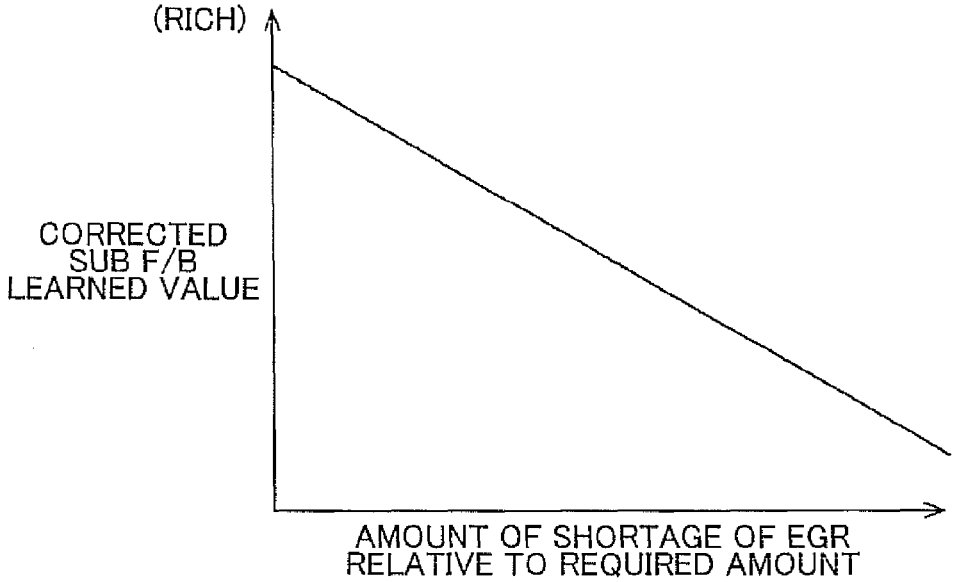
FIG. 6 is a graph indicating the relationship between a sub feedback learned value corrected according to the sub feedback learned value correcting routine, and the amount of shortage of EGR gas.
Figure 7:
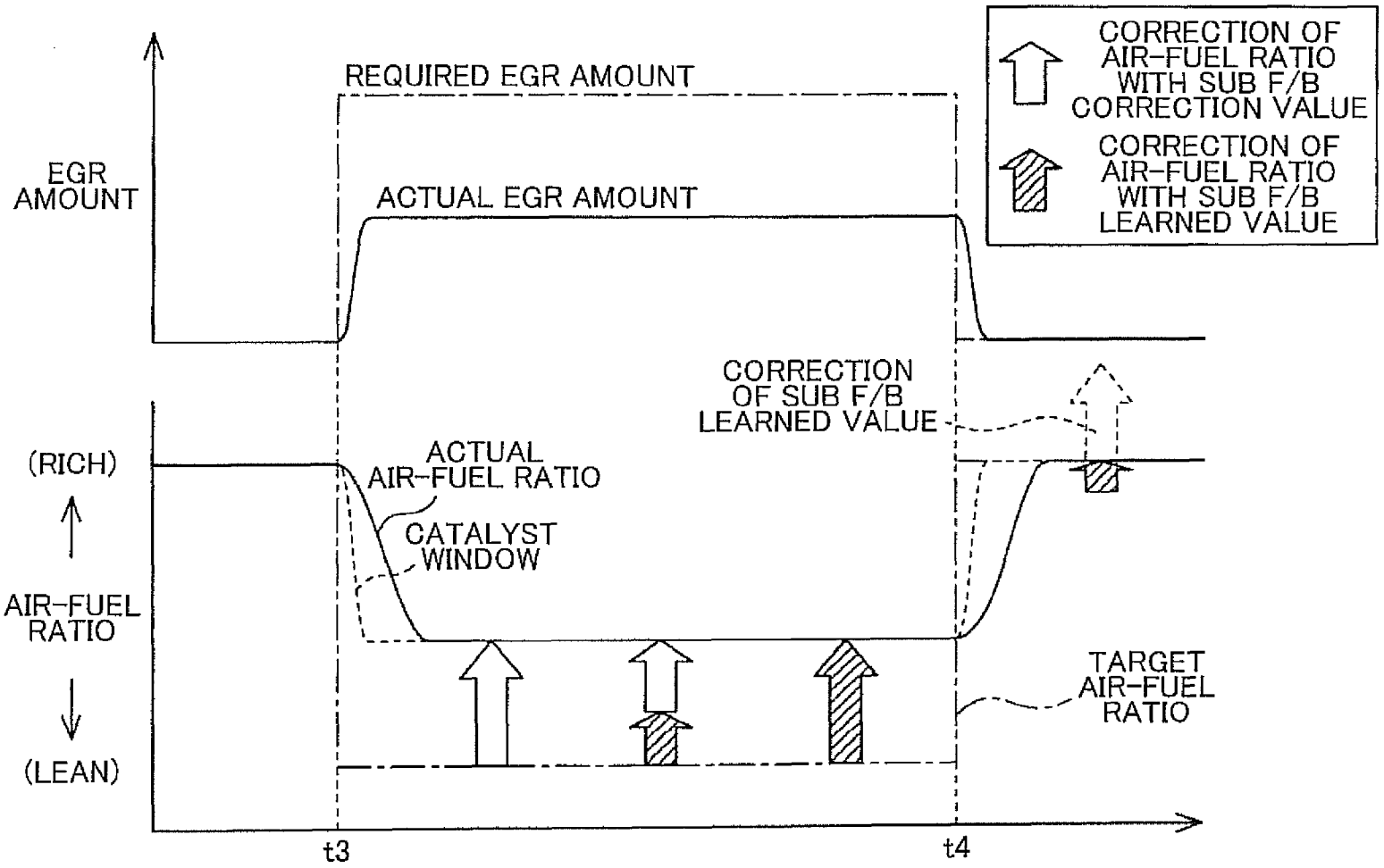
FIG. 7 is a time chart indicating one example of control operation under air-fuel ratio feedback control of the second embodiment.

Next, a second embodiment of the invention in the form of an air-fuel ratio control system of an internal combustion engine will be described in detail with reference to FIG. 5 through FIG. 7. In this embodiment, the same reference numerals are assigned to constituent elements having substantially the same construction and operation as those of the first embodiment, and these elements will not be described in detail.

In the first embodiment, when an inappropriate value is learned as the sub feedback learned value evafsfbg due to shortage of the EGR amount, the target air-fuel ratio eabyfref to be achieved when the EGR is not conducted is corrected so as to reduce or eliminate the deviation of the air-fuel ratio after the EGR is stopped. On the other hand, in this embodiment, the sub feedback learned value evafsfbg to which an inappropriate value was set by learning is corrected so as to reduce or eliminate the deviation of the air-fuel ratio after the EGR is stopped.

Figure 5:
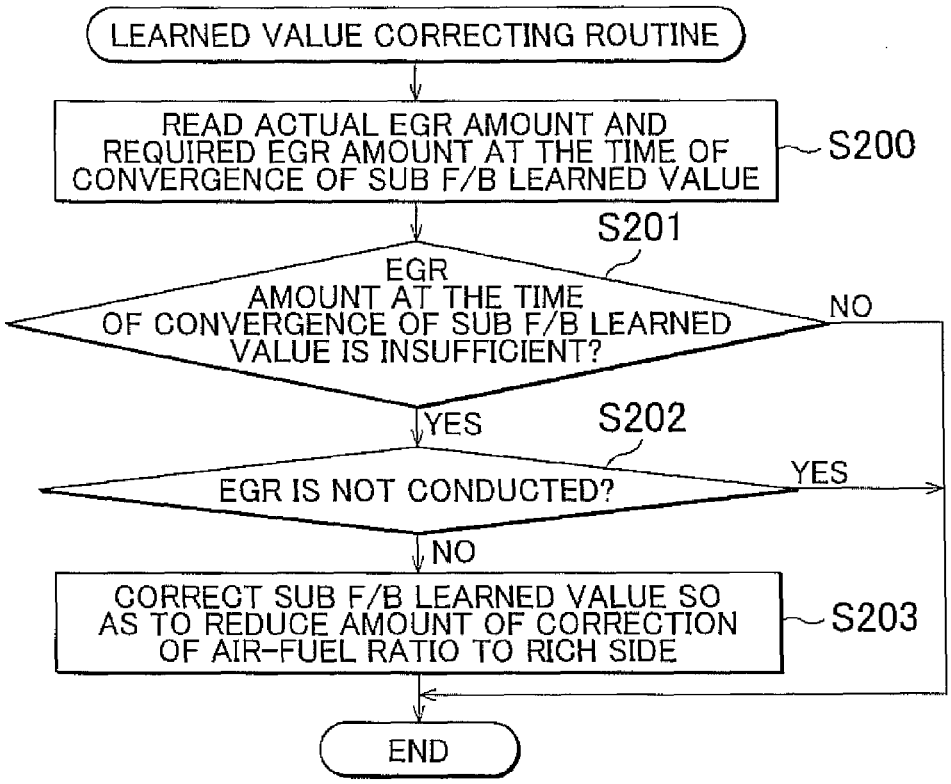
FIG. 5 is a flowchart illustrating a series of steps of a learned value correcting routine executed in a second embodiment of the invention.

The control for suppressing deterioration of emissions when the EGR fails in this embodiment is performed through a learned value correcting routine as shown in FIG. 5. The electronic control unit 19 repeatedly executes the routine of FIG. 5 at specified control intervals during operation of the engine.

Once the processing of this routine is started, the required EGR amount and the actual EGR amount at the time of convergence of the sub feedback (sub F/B) learned value evafsfbg are read in step S200. In the following step S201, it is determined whether the EGR amount is insufficient when the sub feedback learned value evafsfbg converges. If the EGR amount is not insufficient when the sub feedback learned value evafsfbg converges (S201: NO), the current cycle of this routine ends. On the other hand, if the EGR amount is insufficient when the sub feedback learned value evafsfbg converges (S201: YES), the control proceeds to step S202.

In step S202, it is determined whether the EGR is not being conducted at the moment. If the EGR is being conducted (S202: YES), the current cycle of this routine ends. If the EGR is not being conducted (S202: NO), the control proceeds to step S203.

In step S203, the sub feedback learned value evafsfbg is corrected, and then, the current cycle of this routine ends. As shown in FIG. 6, the sub feedback learned value evafsfbg is corrected so that the amount of correction of the air-fuel ratio to the rich side due to the sub feedback learned value evafsfbg is reduced as the amount of shortage of the EGR amount relative to the required amount at the time of convergence of the sub feedback learned value evafsfbg is larger.

The operation during the air-fuel ratio feedback control according to this embodiment will be described with reference to FIG. 7. In the control example of FIG. 7, the EGR is started at time t3, and the EGR is stopped at time t4. While the EGR is conducted from time t3 to time t4, the actual EGR amount is kept short of or smaller than the required EGR amount due to sticking of the EGR valve 18. Therefore, the target air-fuel ratio eabyfref during implementation of the EGR deviates from the catalyst window of the front catalyst 13, and the deviation is compensated for through correction of the air-fuel ratio using the sub feedback correction value evafsfb. As the air-fuel ratio feedback control is continued in the condition where the target air-fuel ratio eabyfref deviates from the catalyst window, the deviation of the target air-fuel ratio eabyfref is taken into the sub feedback learned value evafsfbg. Therefore, if the sub feedback learned value evafsfbg is reflected as it is by the air-fuel ratio, in a condition where the deviation of the target air-fuel ratio eabyfref from the catalyst window of the front catalyst 13 is eliminated, after the EGR is stopped at time t4, the air-fuel ratio may largely deviate to the rich side from the catalyst window of the front catalyst 13.

In this embodiment, when the EGR is not conducted, the sub feedback learned value evafsfbg is corrected, under the condition that the EGR amount at the time of convergence of the sub feedback learned value evafsfbg was short of the required amount. The sub feedback learned value evafsfbg is corrected so as to reduce the amount of correction of the air-fuel ratio to the rich side, which correction is made by the sub feedback learned value evafsfbg. Therefore, the air-fuel ratio is less likely or unlikely to deviate from the catalyst window of the front catalyst 13 due to the sub feedback learned value evafsfbg learned in the condition where the EGR amount was insufficient.

The air-fuel ratio control system of the internal combustion engine according to this embodiment yields the following effects. In this embodiment, when the EGR is not conducted, the sub feedback learned value evafsfbg is corrected if the constant component of the sub feedback correction value evafsfb obtained when the EGR amount is short of the required amount is stored as the sub feedback learned value evafsfbg. Therefore, a deviation of the air-fuel ratio, which appears because the sub feedback learned value evafsfbg learned in the condition where the EGR amount is short of the required amount is reflected as it is by the air-fuel ratio feedback control after the EGR is stopped, is reduced or eliminated. This embodiment makes it possible to favorably suppress deterioration of emissions of the internal combustion engine when the EGR was not normally conducted.

In this embodiment, the sub feedback learned value evafsfbg used when the EGR is not conducted is corrected so that the amount of correction of the air-fuel ratio to the rich side, which is made by the sub feedback learned value evafsfbg, is reduced as the amount of shortage of the EGR amount relative to the required amount is larger. Therefore, deterioration of emissions of the internal combustion engine when the EGR was not normally conducted can be more appropriately suppressed.

The illustrated embodiments may be modified as follows. In the first embodiment, in step S103 of the target air-fuel ratio correcting routine, the target air-fuel ratio eabyfref to be achieved when the EGR is not conducted is corrected to a leaner value as the amount of shortage of the EGR gas at the time of convergence of the sub feedback learned value evafsfbg is larger. However, deterioration of the emissions may be suppressed to some extent even if the target air-fuel ratio eabyfref at this time is uniformly corrected without depending on the amount of shortage of the EGR gas.

In the first embodiment, when the EGR amount at the time of convergence of the sub feedback learned value evafsfbg is short of the required amount, the target air-fuel ratio eabyfref of the main feedback control to be achieved when the EGR is not conducted is corrected to the lean side, so as to suppress deterioration of emissions of the internal combustion engine when the EGR was not normally conducted. It is also possible to suppress deterioration of emissions, by correcting the sub feedback target value, in place of the target air-fuel ratio eabyfref of the main feedback control. The sub feedback target value to be achieved when the EGR is not conducted is set to the output value of the sub oxygen concentration sensor 14 corresponding to the stoichiometric air-fuel ratio. In the above case where the EGR amount at the time of convergence of the sub feedback learned value evafsbg was short of the required amount, the sub feedback target value to be achieved when the EGR is not conducted is corrected to an output value corresponding to a leaner air-fuel ratio than the stoichiometric air-fuel ratio, so that deterioration of emissions can be suppressed. The sub feedback target value to be achieved when the EGR is not conducted is set to an output value corresponding to a leaner air-fuel ratio as the amount of shortage of the EGR gas at the time of convergence of the sub feedback learned value evafsfbg is larger, so that deterioration of emissions can be appropriately suppressed.

In the second embodiment, in step S203 of the learned value correcting routine, the sub feedback learned value evafsfbg used when the EGR is not conducted is corrected so that the amount of correction of the air-fuel ratio to the rich side, which is made by the sub feedback learned value evafsfbg, is reduced to be smaller as the amount of shortage of the EGR gas at the time of convergence of the sub feedback learned value evafsfbg is larger. However, deterioration of the emissions may be suppressed to some extent even if the sub feedback learned value evafsfbg is uniformly corrected without depending on the amount of shortage of the EGR gas.

While the target air-fuel ratio eabyfref is calculated according to the above expression (2) in the illustrated embodiments, the manner of setting the target air-fuel ratio eabyfref is not limited to this, but may be changed as appropriate, provided that the target air-fuel ratio eabyfref is set to values that are different depending on whether or not the EGR is conducted.

While the sub feedback control is performed by correcting the output of the main oxygen concentration sensor 12 based on the oxygen concentration of exhaust gas downstream of the front catalyst 13 in the illustrated embodiments, the sub feedback control may be performed by other methods. For example, sub feedback control may be performed so as to correct the target air-fuel ratio eabyfref of the main feedback control based on the oxygen concentration of exhaust gas downstream of the front catalyst 13, for example.

What is claimed is:

1. An air-fuel ratio control system of an internal combustion engine, the air-fuel ration control system comprising:

an electronic control unit operatively connected to the internal combustion engine, the electronic control unit configured to perform air-fuel ratio feedback control through main feedback control based on a concentration of oxygen in exhaust gas upstream of a catalyst and sub feedback control based on the concentration of oxygen in exhaust gas downstream of the catalyst, the electronic control unit configured to store a constant component of a sub feedback correction value of the sub feedback control as a sub feedback learned value, and the electronic control unit is configured to set a feedback target value of the main feedback control to values that are different depending on whether or not exhaust gas is recirculated into intake air, the electronic control unit is configured to correct the feedback target value of the main feedback control when the recirculation of exhaust gas is not conducted when the constant component of the sub feedback correction value obtained when an amount of recirculated exhaust gas is short of a required amount thereof is stored as the sub feedback learned value, the electronic control unit configured to operate the internal combustion engine in response to the corrected feedback target value of the main feedback control.

2. The air-fuel ratio control system of the internal combustion engine according to claim 1, wherein the feedback target value is corrected so that the feedback target value to be achieved when the recirculation of exhaust gas is not conducted is set to a value that provides a leaner air-fuel ratio as the amount of shortage of recirculated exhaust gas relative to a required amount thereof is larger.

3. An air-fuel ratio control system of an internal combustion engine, the air-fuel ration control system comprising:

an electronic control unit operatively connected to the internal combustion engine, the electronic control unit configured to perform air-fuel ratio feedback control through main feedback control based on a concentration of oxygen in exhaust gas upstream of a catalyst and sub feedback control based on the concentration of oxygen in exhaust gas downstream of the catalyst, the electronic control unit configured to store a constant component of a sub feedback correction value of the sub feedback control as a sub feedback learned value, and the electronic control unit is configured to set a feedback target value of the main feedback control to values that are different depending on whether or not exhaust gas is recirculated into intake air, the electronic control unit is configured to correct a feedback target value of the sub feedback control when the recirculation of exhaust gas is not conducted when the constant component of the sub feedback correction value obtained when an amount of recirculated exhaust gas is short of a required amount is stored as the sub feedback learned value, the electronic control unit configured to operate the internal combustion engine in response to the corrected feedback target value of the sub feedback control.

4. The air-fuel ratio control system of the internal combustion engine according to claim 3, wherein the feedback target value is corrected so that the feedback target value to be achieved when the recirculation of exhaust gas is not conducted is set to a value that provides a leaner air-fuel ratio as the amount of shortage of recirculated exhaust gas relative to a required amount thereof is larger.

5. An air-fuel ratio control system of an internal combustion engine, the air-fuel ration control system comprising:

an electronic control unit operatively connected to the internal combustion engine, the electronic control unit configured to perform air-fuel ratio feedback control through main feedback control based on a concentration of oxygen in exhaust gas upstream of a catalyst and sub feedback control based on the concentration of oxygen in exhaust gas downstream of the catalyst, the electronic control unit configured to store a constant component of a sub feedback correction value of the sub feedback control as a sub feedback learned value, and the electronic control unit is configured to set a feedback target value of the main feedback control to values that are different depending on whether or not exhaust gas is recirculated into intake air, the electronic control unit is configured to correct the sub feedback learned value when the recirculation of exhaust gas is not conducted when the constant component of the sub feedback correction value obtained when an amount of recirculated exhaust gas is short of a required amount thereof is stored as the sub feedback learned value, the electronic control unit configured to operate the internal combustion engine in response to the corrected sub feedback learned value.

6. The air-fuel ratio control system of the internal combustion engine according to claim 5, wherein the sub feedback learned value is corrected so that an amount of correction of the air-fuel ratio to the rich side, which is made by the sub feedback learned value, is reduced as an amount of shortage of the amount of recirculated exhaust gas relative to the required amount is larger.

* * * * *

UNITED STATES PATENT AND TRADEMARK OFFICE

CERTIFICATE OF CORRECTION

PATENT NO. : 9,255,532 B2
APPLICATION NO. : 13/676455
DATED : February 9, 2016
INVENTOR(S) : Takeshi Genko It is certified that error appears in the above-identified patent and that said Letters Patent is hereby corrected as shown below:

IN THE SPECIFICATION

In Column 1, Line 35, delete "accordance, with" and insert --accordance with--, therefor.

In Column 1, Line 44, after "ratio suitable", delete "far" and insert --for--, therefor.

In Column 8, Line 9, after "output evafbse", delete "or" and insert --of--, therefor.

In Column 9, Line 65, after "sub feedback", delete "(sub FIB)" and insert --(sub F/B)--, therefor.

Signed and Sealed this
Third Day of May, 2016

Michelle K. Lee

Michelle K. Lee
*Director of the United States Patent and Trademark Office*